United States Patent [19]

Dean

[11] Patent Number: 4,697,364

[45] Date of Patent: Oct. 6, 1987

[54] NOVELTY CARD

[76] Inventor: James G. Dean, 201 E. Bessemer Ave., Apt. #5, Greensboro, N.C. 27401

[21] Appl. No.: 829,512

[22] Filed: Feb. 14, 1986

[51] Int. Cl.[4] ..... G09F 19/00

[52] U.S. Cl. ..... 40/445; 40/491

[58] Field of Search ..... 40/445, 491, 488, 486; 434/368, 405, 410; 272/8 N, 8 D

[56] References Cited

U.S. PATENT DOCUMENTS

| | | | |
|---|---|---|---|
| 418,135 | 12/1889 | Kaufmann | 40/491 |
| 946,407 | 1/1910 | Spiegel | 40/491 |
| 2,359,195 | 9/1944 | Berliner et al. | 434/410 |
| 2,367,967 | 1/1945 | Schwartz | 40/445 |
| 2,611,201 | 9/1952 | Bellis | 434/368 |
| 3,848,348 | 11/1974 | Hawley | 40/445 |

FOREIGN PATENT DOCUMENTS

| | | | |
|---|---|---|---|
| 675561 | 12/1963 | Canada | 40/488 |
| 2291041 | 6/1976 | France | 434/368 |

*Primary Examiner*—Gene Mancene
*Assistant Examiner*—Cary E. Stone

[57] ABSTRACT

A novelty card is shown having a front window for viewing a dividable insert which is contained within an envelope and has an image thereon that changes as the insert is slidably removed from the envelope through a top slot. Stops on the insert prevent the insert from totally exiting the envelope. The insert includes a front transparent portion and a rear background portion which are combined upon removal from the envelope to change the image seen by the observer.

6 Claims, 8 Drawing Figures

NOVELTY CARD

BACKGROUND OF THE INVENTION

1. Field of the Invention

This invention relates to a novelty card which may be used for greetings, business, advertising or other purposes and includes a slidable insert having an image thereon which changes as the insert is withdrawn from the envelope.

2. Description of the Prior Art and Objectives of the Invention

Novelty items which change images having a transparent front sheet, a divider and a background portion are well known and have in the past been used by food chains and others due to their low cost and novelty effect. Such prior art devices generally are made in an inexpensive fashion and oftentimes the insert, upon being withdrawn is totally removed from its envelope where it can become damaged or lost. Also such prior art devices do not have a cover or flap to protect the image which is displayed within the front window and such constructions have generally been designed to last for a short time as they are made from relatively thin inexpensive materials.

With the disadvantages and shortcomings of prior art devices known the present invention was conceived in an effort to develop a first quality novelty card which could be used professionally by businesses or others to provide a medium having a unique and attention catching appearance.

It is therefore an objective of the present invention to provide a novelty card which is sturdily designed and in which stops prevent the insert from being removed by the user in normal use and in which the insert is contained within the envelope which is closed except for a single slot.

It is yet another objective of the present invention to provide a novelty card which includes a cover flap which protects the window and image therein during mailing or storage.

It is still another objective of the present invention to provide a novelty card which has a one piece die cut envelope and which is relatively easy and inexpensive to construct.

Various other objectives and advantages of the present invention become apparent to those skilled in the art as a more detailed explanation of the device is set forth below.

SUMMARY OF THE INVENTION

A card for use by individuals, businesses or others is presented which includes a slidable insert that is seen through the envelope window. The insert which can be partially removed from the envelope provides a changing visual image during removal. The insert includes a transparent image containing portion and a background portion that is separated from the transparent portion while in the envelope by a divider. Upon removal or withdrawal of the insert from the envelope the background is seen combined with the transparent portion thereby presenting a different image from that perceived initially through the window with the insert fully inserted.

DESCRIPTION OF THE PREFERRED EMBODIMENT

Figure 1:
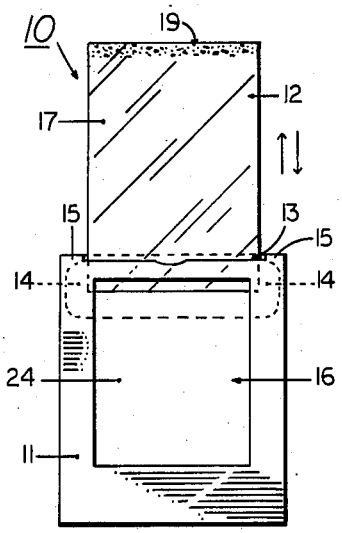
FIG. 1 demonstrates a front elevational view of one embodiment of the invention with the insert extending therefrom.
Figure 2:
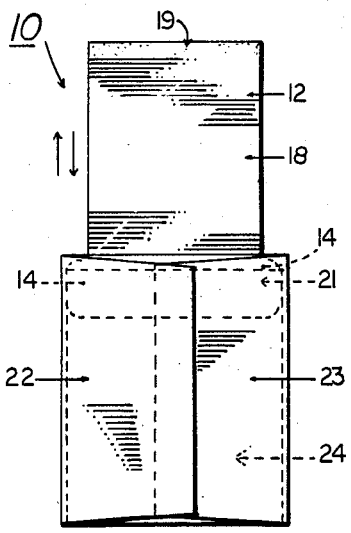
FIG. 2 demonstrates a rear view of the envelope and insert of FIG. 1.
Figure 4:
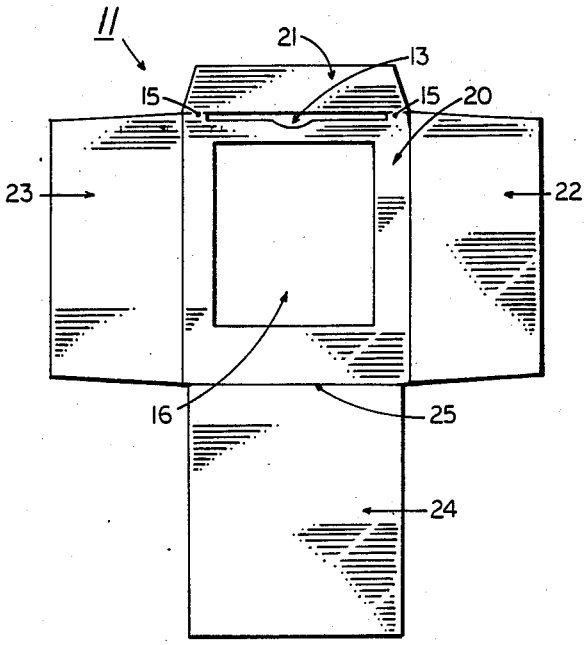
FIG. 4 demonstrates the envelope as shown in FIG. 1 prior to assembly.
Figure 3:
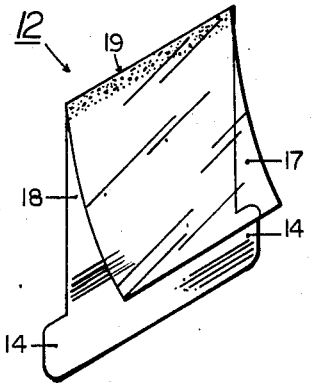
FIG. 3 demonstrates the insert prior to insertion into an envelope.

The invention is shown in its preferred form in FIGS. 1 and 2 in which an envelope is formed from a relatively stiff high quality thin card stock having an opening or window in the front and including a top slot. An insert such as shown in FIG. 3 is contained within the envelope which is positioned with the back or background portion of the insert behind a central divider and with the front transparent portion of the envelope in front of the divider and visible through the window. The insert has complementary figures on its transparent and background portions whereby the insert, upon being withdrawn from the envelope through the top slot causes the background and transparent portion to be seen combined or united thereby presenting an image different from that as initially seen through the front window. Stops are provided on the insert which contact the inside shoulder portions of the envelope proximate the top slot to prevent the insert from being totally withdrawn. The envelope of the preferred embodiment is formed from card stock which can be die cut as a single sheet as shown in FIG. 4 which is folded and glued during assembly. The insert contained therein is formed from a thin transparent acetate sheet which is glued along its top edge to the background portion which may also be die cut from thin card stock.

DETAILED DESCRIPTION OF THE DRAWINGS

For a more complete understanding of the invention, FIG. 1 demonstrates novelty card 10 including envelope 11 and insert 12 which has been partially withdrawn and extends out of slot 13 along the top edge of envelope 11. Stop means 14 are positioned near the bottom of insert 12 (more clearly shown in FIG. 3) which contacts the inside of shoulders 15 of envelope 11 thereby preventing total withdrawal of insert 12. Window 16 allows the observer to see the front transparent portion 17 of insert 12 as illustrated in FIG. 3 whereas background portion 18 of insert 12 cannot be seen in FIG. 1 as divider 24 separates insert 12 when insert 12 is fully contained therein as shown in FIG. 7A. Insert 12 as demonstrated in FIG. 3 is formed from background portion 18 which may be cut from thin card stock or otherwise and transparent portion 17 is formed from a transparent material such as an acetate sheet and is adhered by glue or otherwise to background portion 18 along top edge 19 as shown in FIG. 3. By adhering transparent portion 17 to background portion 18 along top edge 19, insert 12 can then "straddle" divider 24 and the transparent and background portions are easily separated by divider 24 when reinserted into envelope 11.

Figure 8:
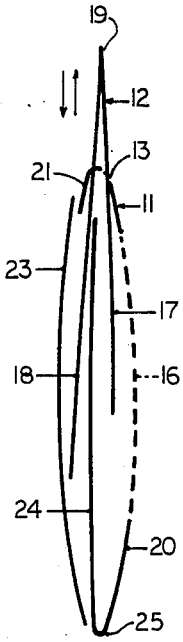
FIG. 8 depicts a cross sectional view of the card as shown in FIG. 7B.

Envelope 11 is depicted in unfolded or unassembled form in FIG. 4. Envelope 11 includes front 20, back 21, sides 22, 23 and divider 24. Slot 13 is formed along the top edge of front 20 at the juncture of front 20 and back 21 but does not completely extend along the width of front 20 and thereby provides shoulders 15 which engage stop means 14 as earlier explained. As would also be understood, divider 24 is folded upwardly to be contained between front 20 and sides 22, 23 and back 21. Sides 22, 23 and back 21 are adhesively secured as shown in FIG. 2 but divider 24 is only joined to front 20 along bottom edge 25 and is not attached to sides 22, 23 or back 21 and "floats" within envelope 11 as seen in FIG. 8.

Figure 7:
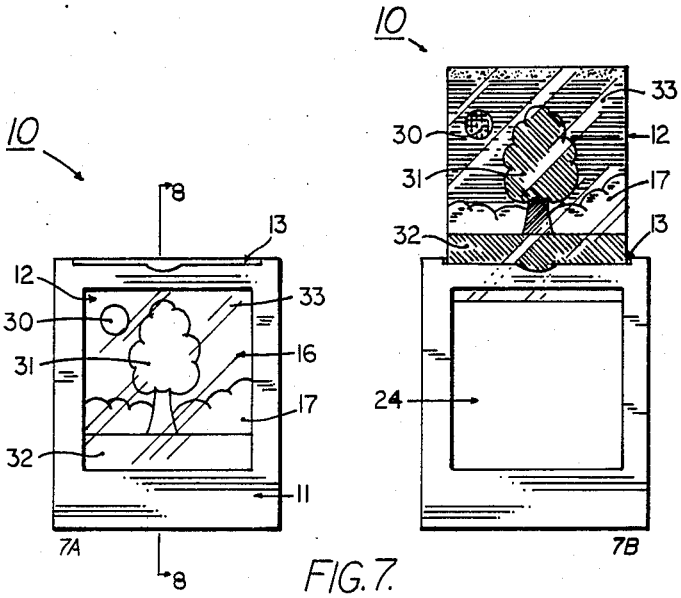
FIG. 7 demonstrates the image of the insert within (7A) and also withdrawn (7B) from the envelope.

For a better understanding of the operation and uniqueness which card 10 provides, FIG. 7 represents a front view of card 10 with insert 12 contained within envelope 11 and through window 16 a scene is presented in which sun 30, tree 31, earth 32 and sky 33 are shown. As insert 12 is pulled upwardly through slot 13 transparent portion 17 unites or comes into contact with background portion 18 (not shown in FIG. 7) and the scene then changes to a night scene with sun 30, tree 31, earth 32 and sky 33 darkening to demonstrate in FIG. 7B a night time scene. This occurs as a result of background portion 18 (not shown in FIG. 7) of insert 12 being seen (fully or partially) through transparent portion 17 with colors or lines which combine or add to the colors and lines on transparent portion 17 to thereby change the visual appearance of the scene. Various other scene changes can equally be provided by varing the color content and combinations of transparent portion 17 and background portion 18 whether such modifications be color changes, advertising slogan additions, line additions or the like.

Figure 5:
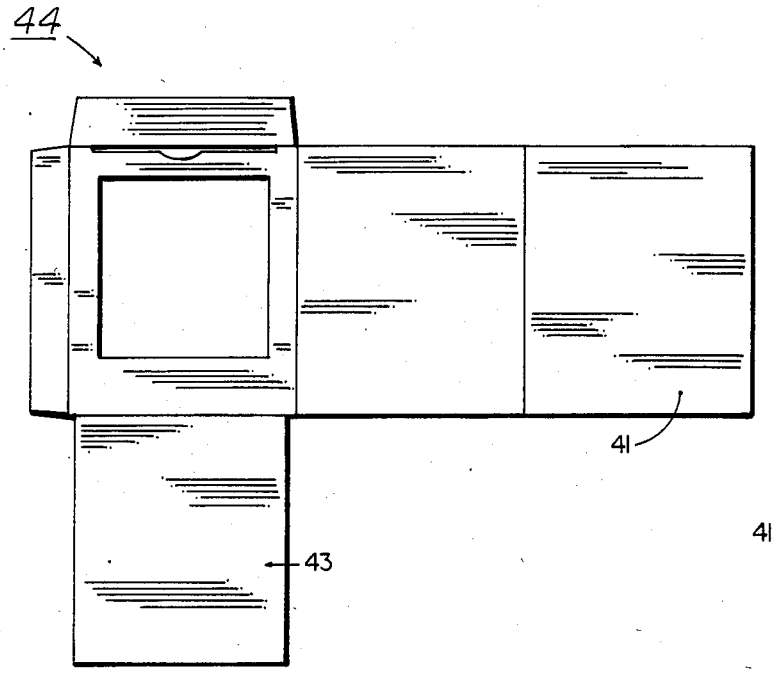
FIG. 5 demonstrates another embodiment of an envelope in unassembled form.
Figure 6:
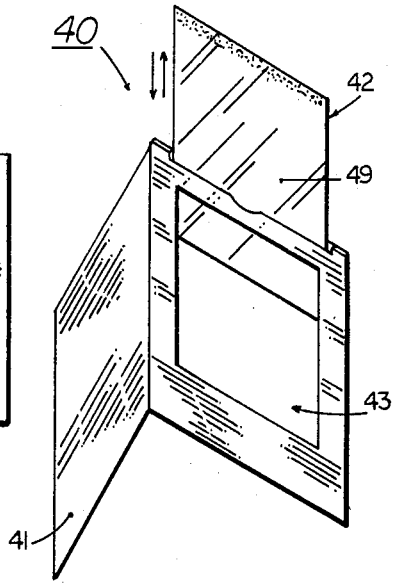
FIG. 6 shows the envelope of FIG. 5 assembled with the insert extending therefrom.

Another embodiment of the novelty card as shown in FIG. 6 in which card 40 is shown having cover flap 41 thereon. Insert 42 is comparable to insert 12 as explained earlier whereby insert 42 straddles divider 43 as shown in FIG. 5 on envelope 44. As shown, cover flap 41 protects transparent portion 49 of insert 42 and can carry an additional message or slogan thereon.

Changes and modifications can be made by those skilled in the art to the embodiments as disclosed herein and such examples and illustrations are for explanatory purposes and are not intended to limit the scope of the appended claims.

I claim:

1. A novelty card comprising an envelope and a slidable insert positioned therein, said envelope defining a slot, a divider, said divider attached to said envelope at the bottom inside said envelope and spaced from said slot, said divider extending upwardly within said envelope, said insert having a stop means attached thereto, said insert having front and rear portions for straddling said divider whereby said insert can be partially withdrawn from said envelope through said slot and said stop means preventing total withdrawal.

2. A novelty card as claimed in claim 1 and including a cover flap, said flap attached to said envelope.

3. A novelty card comprising an envelope and a slidable insert positioned therein, said envelope having a front, a side, a back and a divider, said divider connected to said front along the bottom edge thereof, said side and back joined to said front, said back joined to said front along the top edge of said front, said top edge of said front and said back defining a slot, said front having a window therein, said insert having a transparent portion and a background portion, said transparent and said background portions being attached to each other along one edge, said insert including a stop means, said transparent portion and said background portion being separable for straddling said divider whereby withdrawing said insert from said envelope allows said transparent portion and said background portion to unite.

4. A novelty card as claimed in claim 3 wherein said stop means is positioned on said background portion of said insert.

5. A novelty card as claimed in claim 3 wherein said stop means prevents said insert from completely exiting said envelope.

6. A novelty card as claimed in claim 3 and including a plurality of sides.

* * * * *